US009938889B2

(12) United States Patent
Kurata et al.

(10) Patent No.: US 9,938,889 B2
(45) Date of Patent: Apr. 10, 2018

(54) TWO-STROKE ENGINE

(71) Applicant: HONDA MOTOR CO., LTD., Tokyo (JP)

(72) Inventors: Mashu Kurata, Tokyo (JP); Toru Kawai, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 133 days.

(21) Appl. No.: 14/640,674

(22) Filed: Mar. 6, 2015

(65) Prior Publication Data

US 2015/0260083 A1 Sep. 17, 2015

(30) Foreign Application Priority Data

Mar. 11, 2014 (JP) ..... 2014-047275

(51) Int. Cl.

| | |
|---|---|
| ***F02M 67/02*** | (2006.01) |
| ***F02B 25/02*** | (2006.01) |
| ***F02B 25/22*** | (2006.01) |
| *F02B 75/02* | (2006.01) |

(52) U.S. Cl.

CPC ..... *F02B 25/02* (2013.01); *F02B 25/22* (2013.01); *F02B 2075/025* (2013.01)

(58) Field of Classification Search

CPC ..... F02B 25/02; F02B 2075/025; F02F 25/22

USPC .... 123/73 R, 73 A, 73 B, 73 C, 73 V, 73 PP, 123/74 A, 74 B, 65 V, 65 VA, 65 P

See application file for complete search history.

(56) References Cited

U.S. PATENT DOCUMENTS

| | | | | |
|---|---|---|---|---|
| 3,815,558 A * | 6/1974 | Tenney | F02B 25/00 | 123/73 A |
| 4,066,050 A * | 1/1978 | Ford-Dunn | F01L 3/205 | 123/73 A |
| 4,242,993 A | 1/1981 | Onishi | | |
| 5,092,288 A * | 3/1992 | Staerzl | F01L 3/205 | 123/468 |

(Continued)

FOREIGN PATENT DOCUMENTS

| | | |
|---|---|---|
| JP | S54-106722 A | 8/1979 |
| JP | 3143375 B2 | 3/2001 |
| JP | 2012-102740 A | 5/2012 |

OTHER PUBLICATIONS

Office Action dated Jul. 18, 2017, issued in counterpart Japanese Application No. 2014-047275. (2 pages).

*Primary Examiner* — Marguerite McMahon

(74) *Attorney, Agent, or Firm* — Westerman, Hattori, Daniels & Adrian, LLP

(57) ABSTRACT

A two-stroke engine includes: an intake passage that opens out to a crank chamber; a first one-way valve provided in the intake passage and permits a flow of fluid toward the crank chamber; a scavenging port having an upstream end communicating with the crank chamber and a downstream end that opens out in a wall defining a side portion of a cylinder, wherein the downstream end communicates with a combustion chamber defined above the piston at least when the piston is at a bottom dead center, and communicates with a part of the cylinder below the piston at least when the piston is at a top dead center; and an air supply passage that communicates a part of the intake passage which is located downstream of the first one-way valve with an upstream portion of the scavenging port so as to supply air to the scavenging port during air intake.

7 Claims, 10 Drawing Sheets

(56) References Cited

U.S. PATENT DOCUMENTS

| | | | | | |
|---|---|---|---|---|---|
| 5,094,217 | A * | 3/1992 | Kaku | F01P 1/10 | 123/198 E |
| 5,251,580 | A * | 10/1993 | Torigai | F02B 25/14 | 123/65 P |
| 5,613,468 | A * | 3/1997 | Ibara | F02B 25/14 | 123/184.54 |
| 5,700,402 | A * | 12/1997 | Jones | F02M 59/107 | 123/73 C |
| 6,647,713 | B1 * | 11/2003 | Miyajiri | F01N 3/28 | 123/73 A |
| 2002/0139326 | A1 * | 10/2002 | Araki | F02B 25/22 | 123/73 PP |
| 2003/0116107 | A1 * | 6/2003 | Laimbock | F02B 25/14 | 123/73 PP |
| 2004/0045517 | A1 * | 3/2004 | Fleig | F02B 17/00 | 123/73 PP |
| 2004/0079304 | A1 * | 4/2004 | Notaras | F02B 25/18 | 123/73 F |
| 2006/0272599 | A1 * | 12/2006 | Johnson | F02B 17/005 | 123/73 A |
| 2011/0162630 | A1 | 7/2011 | Takayanagi | | |
| 2014/0182571 | A1 * | 7/2014 | Takayanagi | F02B 43/02 | 123/73 PP |

* cited by examiner

E
A
6
II
5
1
43B
34
43
33
32
31
28
29
4
23
3
24
23A
18A
21
19
18
64
56C
55
55
56
56C
56B
56B
56D
66
III
III
56D
58
57
26
60
58
54
56A
16
53
56A
22
16A
2
2D
25
8C
2E
8
68
2A
8B
II

A
33
43B
43
5
6
32
34
E
29
43A
30
52
1
4
31
28
23
23A
21
18A
51
18
19
3
56C
24
55
55
56C
56B
56B
56
56
56D
42
2
60
56D
58
58
22
41
56A
26
56A
16
16A
2B
47
8C
46
7
8D
8E
25
8
8B
8B
8A
13
13
8A
2A
45
11
7
2C
12

TWO-STROKE ENGINE

TECHNICAL FIELD

The present invention relates to a two-stroke engine, and particularly relates to a technology for making it possible to perform stratified scavenging even when a long-stroke piston is used.

BACKGROUND OF THE INVENTION

Conventionally, a two-stroke engine is provided with a scavenging port that communicates a side portion of the interior of the cylinder with the crank chamber, so that an air-fuel mixture containing fuel is supplied from the crank chamber into the cylinder via the scavenging port, and this flow of air-fuel mixture displaces or scavenges the combustion gas remaining in the cylinder out of the combustion chamber at the same time. The scavenging orifice at the downstream end of the scavenging port is opened and closed depending on the position of the piston that reciprocates in the cylinder such that the scavenging orifice communicates with the combustion chamber defined in an upper part of the cylinder when the piston is near the bottom dead center, and is shut off by the piston skirt when the piston is near the top dead center.

In such a two-stroke engine, it is known to perform stratified scavenging by providing a scavenging passage in addition to the air-fuel mixture passage (see JP3143375B, for example). In JP3143375B, as shown in FIG. 9A for example, the two-stroke engine is provided with an air-fuel mixture passage 160 that supplies air-fuel mixture to a crank chamber 102A, an air supply passage 157 that supplies air to a scavenging passage 156 extending from a crank chamber 102A to a cylinder 122, an air flow passage 161 located on an upstream side of the air-fuel mixture passage 160 and the air supply passage 157 and connected to both of the air-fuel mixture passage 160 and the air supply passage 157, and a check valve 154 provided in the air flow passage 161, whereby stratified scavenging is performed.

Namely, in this structure, as shown in FIG. 9B, when a piston 123 moves upward, the pressure in the crank chamber 102A decreases and the air-fuel mixture enters the crank chamber 102A via the air-fuel mixture passage 160 while the air enters the crank chamber 102A via the air supply passage 157 and the scavenging passage 156. As shown in FIG. 9C, when the piston moves downward, the pressure in the crank chamber 102A increases, and the air held in the scavenging passage 156 enters the cylinder 122 first, and then, the air-fuel mixture held in the crank chamber 102A is supplied to the cylinder 122, to scavenge out the combustion gas remaining in the cylinder 122. In this way, stratified scavenging is performed, and this prevents an uncombusted air-fuel mixture from flowing out to an exhaust port 131 during the scavenging and thereby suppresses an increase in total hydrocarbons (THC).

However, in such stratified scavenging, it is assumed that the scavenging orifice 155 is closed by the piston side surface when the piston 123 is positioned near the top dead center. Therefore, in a case where a structure with a long piston stroke is adopted to improve the thermal efficiency and as a result the scavenging orifice 155 communicates with the crank chamber 102A via a part of the cylinder 122 below the lower end of the piston skirt when the piston 123 is positioned near the top dead center as shown in FIG. 10A, the stratified scavenging cannot be performed.

In other words, in such a structure, as shown in FIG. 10B, when the pressure in the crank chamber 102A decreases during an upward movement of the piston 123, the air-fuel mixture enters the crank chamber 102A via the air-fuel mixture passage 160 while the air enters the crank chamber 102A directly from the air supply passage 157 through the scavenging orifice 155 without flowing to the scavenging passage 156. Consequently, as shown in FIG. 10C, when the pressure in the crank chamber 102A increases during a download movement of the piston 123, first the air-fuel mixture held in the scavenging passage 156 and then the air-fuel mixture in the crank chamber 102A enter the cylinder 122. Therefore, the uncombusted air-fuel mixture may be discharged through the exhaust port 131 during the scavenging of the combustion gas in the cylinder 122.

It may be conceived to extend the length of the piston skirt to close the scavenging orifice 155 with the piston skirt when the piston 123 is positioned near the top dead center. However, if such a structure were adopted, the piston skirt would come to contact with other component parts (such as a counterweight of the crankshaft) easily when the piston 123 is positioned near the bottom dead center, and in addition, the weight of the piston 123 would increase.

In view of the aforementioned background, an object of the present invention is to make it possible to perform stratified scavenging in a two-stroke engine even when a long piston stroke is adopted.

SUMMARY OF THE INVENTION

To achieve the above object, the present invention provides a two-stroke engine (E), including: an intake passage (53) that opens out to a crank chamber (2A); a first one-way valve (54) provided in the intake passage and permits a flow of fluid toward the crank chamber; a scavenging port (56) having an upstream end communicating with the crank chamber and a downstream end (55) that opens out in a wall (19) defining a side portion of a cylinder (22), wherein the downstream end (55) communicates with a combustion chamber (29) defined above the piston at least when the piston (23), moving up and down in the cylinder, is at a bottom dead center, and communicates with a part of the cylinder (22) below the piston at least when the piston is at a top dead center; and an air supply passage (57) that communicates a part of the intake passage which is located downstream of the first one-way valve and through which air flows with an upstream portion (56E) of the scavenging port and that supplies air to the scavenging port during air intake.

According to this structure, when the piston is moving upward during the air intake with the lower edge of the piston being above the lower edge of the downstream end of the scavenging port, the air flowing into the scavenging port from the air supply passage flows to the downstream side of the scavenging port and is held in the scavenging port. As a result, at the time of scavenging, first the air in the scavenging port and then the air-fuel mixture in the crank chamber flow into the combustion chamber to achieve stratified scavenging.

In the aforementioned invention, preferably, the two-stroke engine further includes a second one-way valve (58) that is provided in the scavenging port (56) and permits the flow of fluid from the upstream end toward the downstream end, wherein the air supply passage (57) is connected to a part of the scavenging port on a side of the downstream end relative to the second one-way valve.

According to this structure, when the piston is moving upward during the air intake with the lower edge of the piston being lower than the lower edge of the downstream end of the scavenging port, the second one-way valve prevents the fluid in the scavenging port from flowing into the crank chamber. This avoids disturbance created in the fluid flowing from the intake passage into the crank chamber during the air intake, thereby homogenizing the air-fuel mixture in the crank chamber.

Further, in the aforementioned invention, preferably, the scavenging port (56) includes a scavenging chamber (56B) defined around the wall (19) defining the side portion of the cylinder (22) and a scavenging passage (56A) that communicates the scavenging chamber and the crank chamber (2A) with each other, the second one-way valve (58) consists of a reed valve provided in the scavenging chamber, and the air supply passage (57) is connected to the scavenging chamber (56B).

According to this structure, the provision of the scavenging chamber can increase the volume of the scavenging port and thereby secure an adequate amount of air to be used in the stratified scavenging. Further, by providing the large-volume scavenging chamber with a reed valve having a simple structure, the installation of the one-way valve permitting the flow of fluid from the scavenging passage to the scavenging chamber can be achieved easily.

Further, in the aforementioned invention, preferably, the scavenging port (56) includes a plurality of scavenging passages (56A) spaced apart from each other in a circumferential direction of the cylinder (22); and the second one-way valve (58) is provided for all the scavenging passages.

According to this structure, in comparison to the case where a single scavenging passage is provided, the velocity of the fluid flowing into the combustion chamber during scavenging can be lowered, and thus, stratified scavenging can be performed in the combustion chamber without the stratified flow being disturbed.

Further, in the aforementioned invention, preferably, the scavenging chamber (56B) has an upper wall surface (56C) located higher than an upper edge (55A) of the downstream end (55) of the scavenging port (56).

According to this structure, the fluid having passed through the scavenging passage impinges upon the upper wall surface of the scavenging chamber such that the upward velocity component thereof is reduced, and thereafter, flows into the combustion chamber. Therefore, stratified scavenging can be performed in the combustion chamber without the stratified flow being disturbed.

Further, in the aforementioned invention, preferably, the two-stroke engine further includes an air amount adjustment device (59) that is provided in the air supply passage (57) and adjusts an amount of air supplied to the scavenging port (56) during air intake.

According to this structure, the amount of air supplied to the scavenging port through the air supply passage during the air intake can be adjusted by the air amount adjustment device (such as a control valve) as desired, and thus, it is possible to prevent the fluid from passing through the scavenging port and flowing into the crank chamber via the downstream end or upstream end of the scavenging port during the air intake, thereby homogenizing the air-fuel mixture in the crank chamber.

According to the foregoing structure, it is possible to perform stratified scavenging in a two-stroke engine even when a long piston stroke is adopted.

DETAILED DESCRIPTION OF THE PREFERRED EMBODIMENTS

In the following, a detailed description will be made of an embodiment of the present invention with reference to the drawings, in which the present invention is applied to a single cylinder, uniflow two-stroke engine (hereinafter referred to as an engine E).

Figure 1:
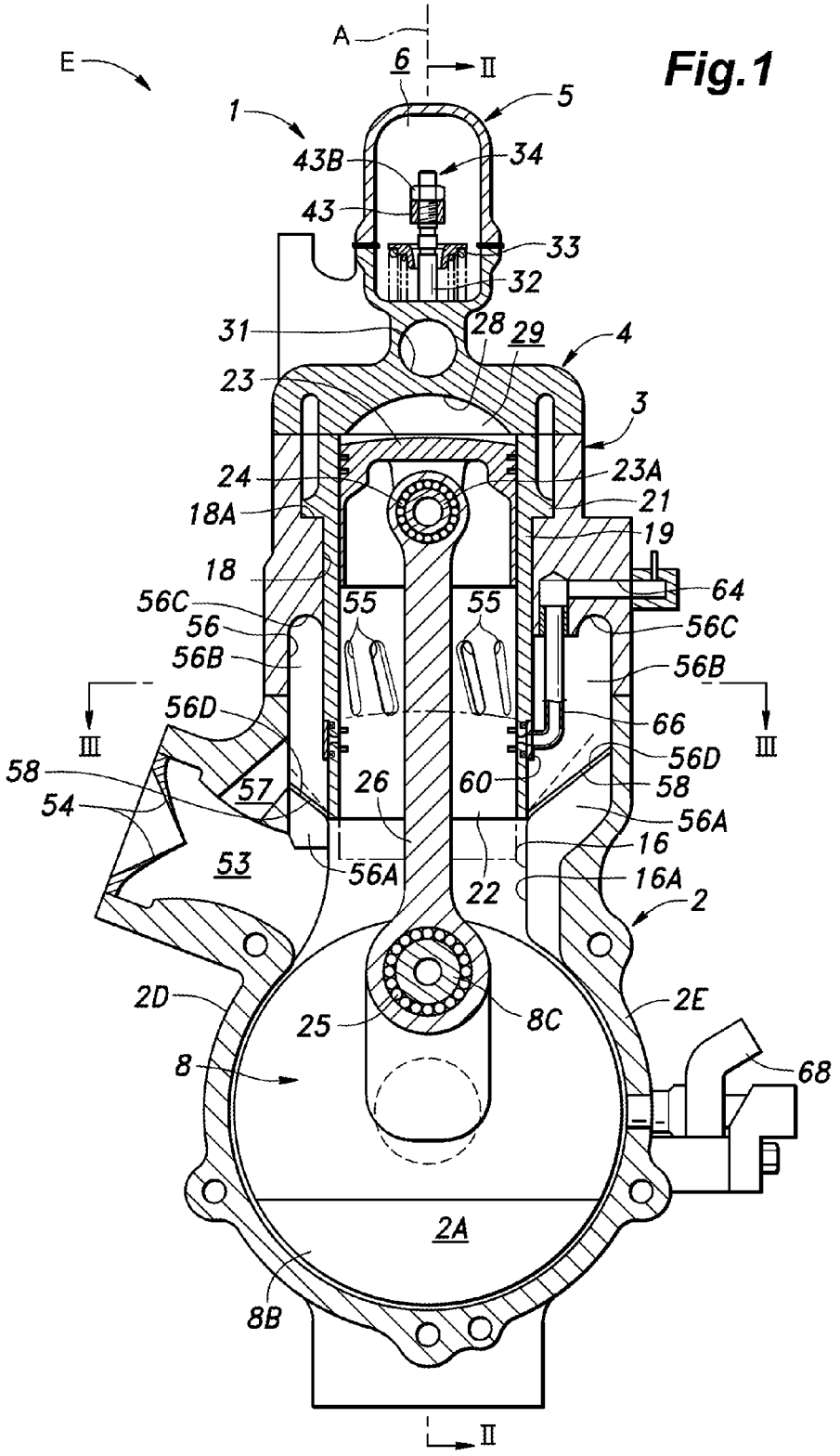
FIG. 1 is a vertical cross-sectional view of an engine according to an embodiment of the present invention.
Figure 2:
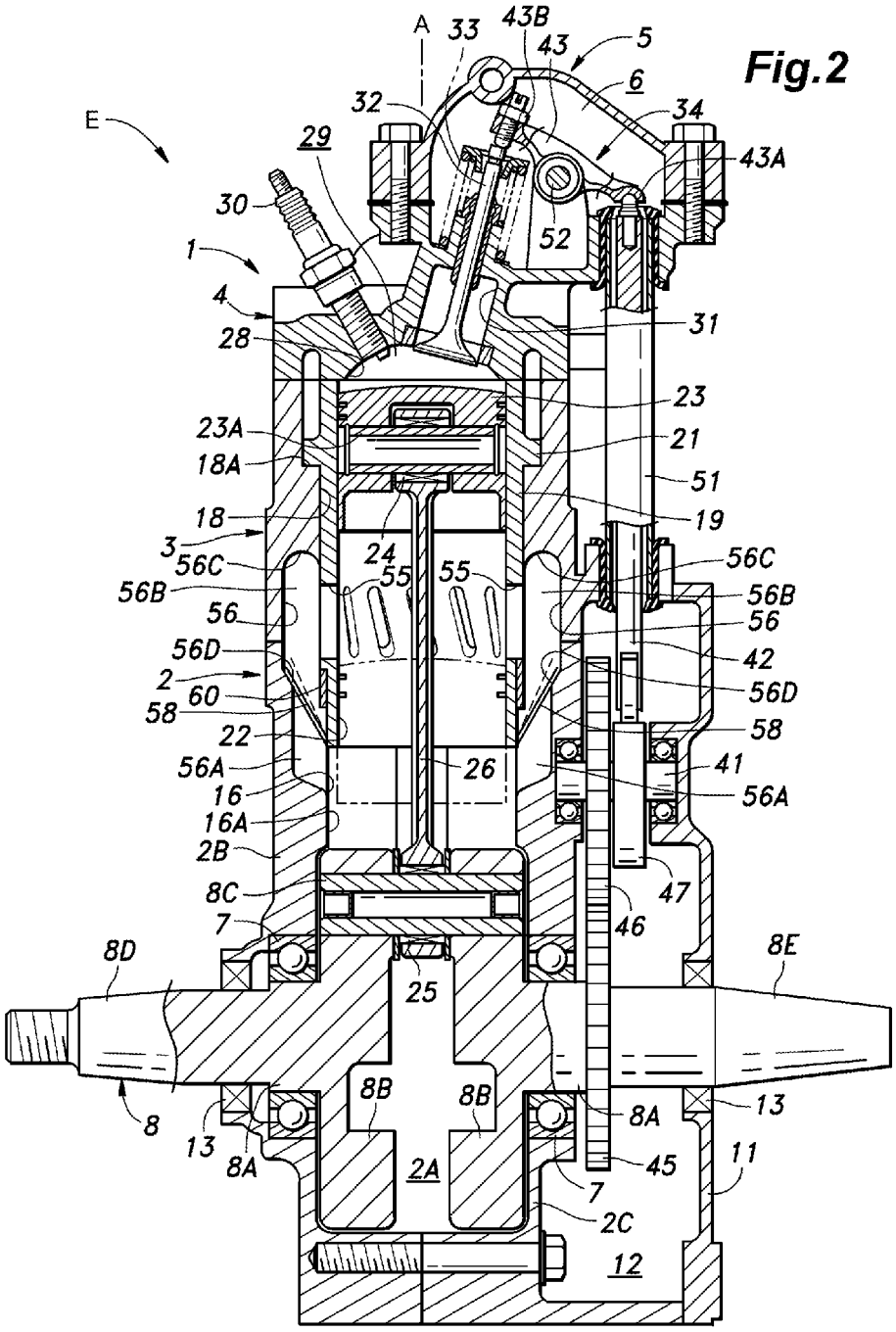
FIG. 2 is a cross-sectional view taken along line II-II in FIG. 1.

As shown in FIG. 1 and FIG. 2, an engine main body 1 of the engine E includes a crankcase 2 defining a crank chamber 2A therein, a cylinder block 3 attached to an upper part of the crankcase 2, a cylinder head 4 attached to an upper part of the cylinder block 3, and a head cover 5 attached to an upper part of the cylinder head 4 and defining an upper valve chamber 6 between itself and the cylinder head 4.

As shown in FIG. 2, the crankcase 2 is constituted of a pair of crankcase halves which are parted laterally by a vertically extending surface (a surface passing the cylinder axis A). The left and right crankcase halves are fastened to each other by bolts and define the crank chamber 2A therebetween. The left and right side walls 2B, 2C of the crankcase 2 rotatably supports a crankshaft 8 via bearings 7.

The crankshaft 8 includes a pair of journals 8A supported by the side walls 2B, 2C of the crankcase 2, a pair of crank webs 8B provided between the journals 8A, and a crankpin 8C supported by the crank webs 8B at a position radially offset from the journals 8A.

An end plate 11 is secured on an outer surface side of the right side wall 2C. The end plate 11 is secured to the outer surface of the right side wall 2C at a periphery thereof and defines a lower valve chamber 12 between itself and the right side wall 2C. The left end portion 8D of the crankshaft 8 passes through the left side wall 2B of the crankcase 2 and extends out to the left. The right end portion 8E of the crankshaft 8 passes through the right side wall 2C of the crankcase 2 and the end plate 11 and extends out to the right. A seal member 13 is provided at each of the part where the left end portion 8D of the crankshaft 8 passes through the left side wall 2B and the part where the right end portion 8E of the same passes through the end plate 11 to ensure an air tight seal of the crank chamber 2A.

The upper part of the crankcase 2 has a first sleeve reception bore 16 formed therein, where the first sleeve reception bore 16 extends vertically, has an upper end that opens out at the upper end surface of the crankcase 2 and a lower end that opens out to the crank chamber 2A, and has a circular cross section.

The cylinder block 3 extends vertically and is fastened to the upper end surface of the crankcase 2 at the lower end surface thereof. The cylinder block 3 is provided with a second sleeve reception bore 18 that extends vertically therethrough from the upper end surface to the lower end surface. The second sleeve reception bore 18 is a stepped bore having a circular cross section, where an upper part of the second sleeve reception bore 18 is given a larger diameter than a lower part such that an upward-facing annular shoulder surface 18A is defined at the interface between the upper part and the lower part. The second sleeve reception bore 18 is aligned coaxially with the first sleeve reception bore 16 of the cylinder block 3 and is connected with the same. The first sleeve reception bore 16 and the lower part of the second sleeve reception bore 18 have the same inner diameter so as to form a continuous bore.

Press-fitted into the first and second sleeve reception bores 16, 18 is a cylinder sleeve 19 having a cylindrical shape. The cylinder sleeve 19 is provided on its outer circumference with an annular projection 21 that projects radially outward. The projection 21 abuts the shoulder surface 18A to determine the position of the cylinder sleeve 19 relative to the first and second sleeve reception bores 16, 18. The lower end of the cylinder sleeve 19 is positioned higher than the lower end of the first sleeve reception bore 16 (the part connected with the crank chamber 2A). Thereby, below a cylinder 22 formed by the inner bore of the cylinder sleeve 19, an upper part of the crank chamber 2A that is connected to the cylinder 22 is defined by an exposed inner circumference 16A of the first sleeve reception bore 16 in a cylindrical shape. The upper end of the cylinder sleeve 19 is positioned so as to be flush with the upper end surface of the cylinder block 3 and abuts the lower end surface of the cylinder head 4 joined to the cylinder block 3. Thereby, the cylinder sleeve 19 is interposed between the shoulder surface 18A and the lower surface of the cylinder head 4, and the position thereof in the direction of the cylinder axis A is determined.

The cylinder 22 receives a piston 23 such that the piston 23 can reciprocate therein. The piston 23 has a piston pin 23A extending in parallel with the crankshaft 8. The piston pin 23A pivotably supports the small end of a connecting rod 26 via a bearing 24. The large end of the connecting rod 26 is pivotably supported by the crankpin 8C via a bearing 25. As the piston 23 and the crankshaft 8 are connected by the connecting rod 26, the reciprocating movement of the piston 23 is converted to the rotational movement of the crankshaft 8.

As shown in FIG. 1 and FIG. 2, a hemispherical combustion chamber recess 28 is formed at a part of the lower end surface of the cylinder head 4 corresponding to the cylinder sleeve 19. The combustion chamber recess 28 defines a combustion chamber 29 between itself and the top surface of the piston 23 and constitutes an upper end portion of the cylinder 22.

The cylinder head 4 is provided with a spark plug 30 so as to face the combustion chamber 29. Further, the cylinder head 4 is provided with an exhaust port 31 opening out at the tope end of the combustion chamber 29 and an exhaust valve 32 consisting of a poppet valve to selectively close and open the exhaust port 31. The exhaust valve 32 has a stem end disposed in the upper valve chamber 6 and is urged by a valve spring 33 in the closing direction. The exhaust valve 32 is opened and closed by a valve actuating mechanism 34 in synchronization with the rotation of the crankshaft 8.

As shown in FIG. 2, the valve actuating mechanism 34 includes a camshaft 41 that rotates in response to the rotation of the crankshaft 8, a pushrod 42 driven to advance and retreat by the camshaft 41, and a rocker arm 43 driven by the pushrod 42 and pushes the exhaust valve 32 in the opening direction. The camshaft 41 is disposed in the lower valve chamber 12 in parallel with the crankshaft 8. The camshaft 41 has one end rotatably supported by the right side wall 2C of the crankcase 2 and the other end rotatably supported by the end plate 11. The crankshaft 8 has a crank gear 45 at a part located in the lower valve chamber 12, and the camshaft 41 has a cam gear 46 engaging the crank gear 45. The gear ratio between the crank gear 45 and the cam gear 46 is 1:1. The camshaft 41 is provided with a cam 47 consisting of a plate cam.

The pushrod 42 is received in a tubular rod case 51 having open ends so as to be capable of advancing and retreating. The rod case 51 extends vertically, and the lower end thereof is joined to the right side wall 2C of the crankcase 2 and in communication with the lower valve chamber 12 while the upper end thereof is joined to the cylinder block 3 and in communication with the upper valve chamber 6. The pushrod 42 is in contact with the cam 47 of the camshaft 41 at its lower end, and advances and retreats in response to the rotation of the camshaft 41. It is also possible to provide the lower end of the pushrod 42 with a roller, so that the pushrod 42 is in rolling contact with the cam 47 via the roller.

The rocker arm 43 is pivotably supported by a rocker shaft 52 supported by the cylinder head 4. The rocker shaft 52 extends in a direction perpendicular to the cylinder axis A and the axis of the crankshaft 8. The rocker arm 43 has at one end thereof a receiving part 43A in contact with the upper end of the pushrod 42 and has at the other end thereof a screw adjuster 43B in contact with the stem end of the exhaust valve 32.

With the valve actuating mechanism 34 having the foregoing structure, each time the crankshaft 8 makes one revolution, the exhaust valve 32 is opened once at a predetermined timing.

As shown in FIG. 1, the front side wall 2D of the crankcase 2 is provided with an intake port 53 serving as an intake passage in communication with the crank chamber 2A. The intake port 53 is formed to extend toward the crankshaft 8 obliquely from above. Near the upstream end of the intake port 53 is provided a reed valve 54 that permits the flow of fluid from the intake port 53 toward the crank chamber 2A while prohibiting the flow of fluid from the crank chamber 2A toward the intake port 53. The reed valve 54 is normally closed, and opens when the piston 23 moves upward and the internal pressure in the crank chamber 2A thereby drops.

A part of the cylinder sleeve 19 vertically overlapping the interface between the first sleeve reception bore 16 and the second sleeve reception bore 18 is provided with scavenging orifices 55 each extending through the cylinder sleeve 19 in the radial direction. Multiple scavenging orifices 55 are formed so as to be spaced apart from each other in the circumferential direction of the cylinder 22, and each is given a vertically elongated shape inclined relative to the cylinder axis A. The vertical dimension of each scavenging orifice 55 is selected to be smaller than that of the outer circumference of the piston 23. A scavenging port 56 that communicates the crank chamber 2A and the scavenging orifices 55 with each other is defined to span from the circumference of the first sleeve reception bore 16 in the upper part of the crankcase 2 to the circumference of the second sleeve reception bore 18 in the lower part of the cylinder block 3.

The scavenging orifices 55 serve as a downstream end of the scavenging port 56, and are opened and closed by the reciprocating movement of the piston 23. Specifically, when the piston 23 is at a position corresponding to the scavenging orifices 55, the scavenging port 56 is closed by the outer circumference of the piston 23, when the lower edge of the piston 23 is located higher than the lower edge 55B (see FIG. 4) of the scavenging orifices 55 (on the side of the top dead center), the scavenging port 56 is opened so as to be in communication with the part of the cylinder 22 below the piston 23, and when the upper edge of the piston 23 is located lower than the upper edge 55A (see FIG. 4) of the scavenging orifices 55 (on the side of the bottom dead center), the scavenging port 56 is opened so as to be in communication with the part of the cylinder 22 above the piston 23 (combustion chamber 29). It is to be noted that in FIG. 1 and FIG. 2, the piston 23 at the top dead center is shown by solid lines while the piston 23 at the bottom dead center is shown by phantom lines.

Figure 3:
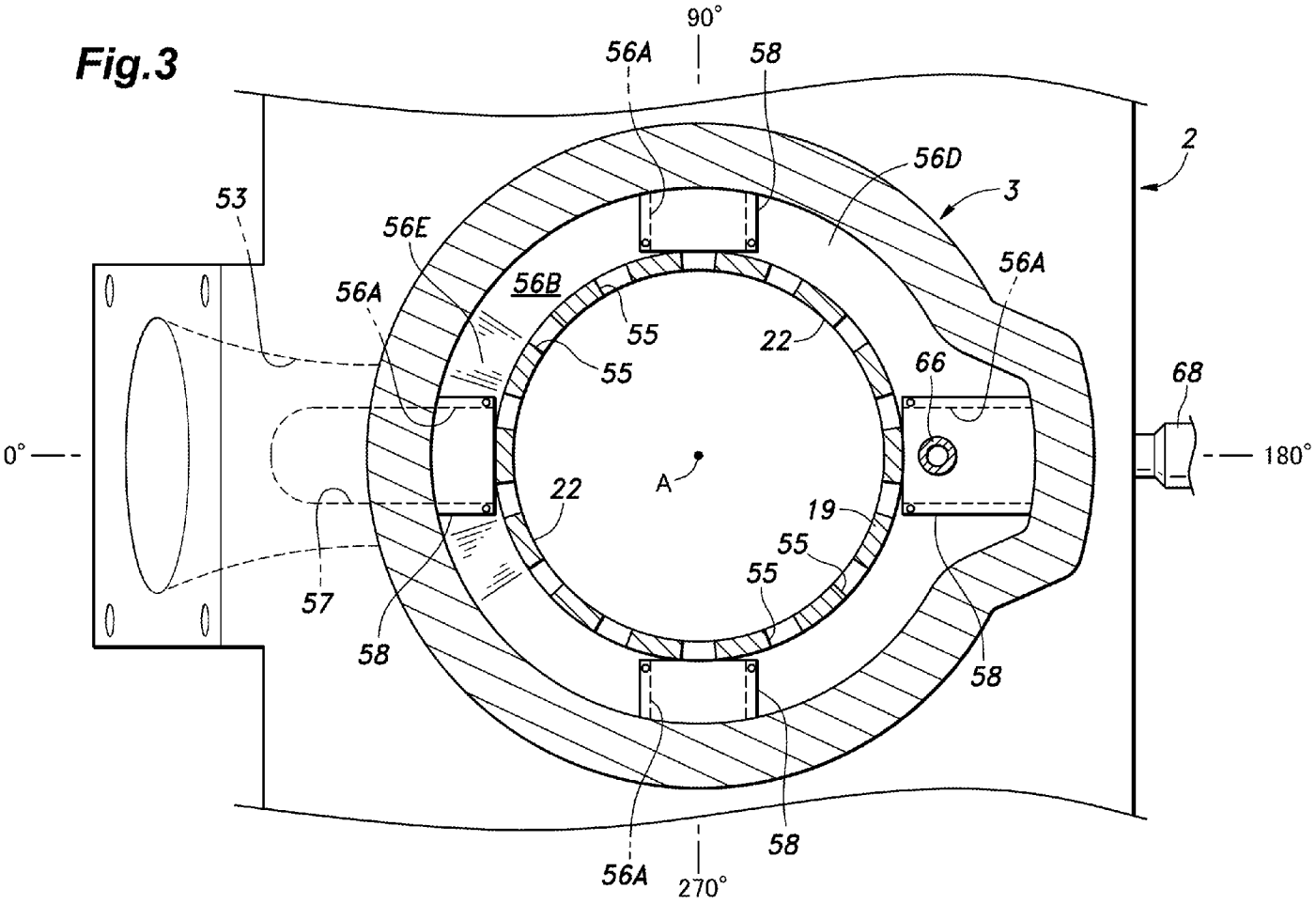
FIG. 3 is a cross-sectional view taken along line III-III in FIG. 1.

As shown in FIG. 3, in the illustrated embodiment, the scavenging orifices 55 include fourteen scavenging orifices arranged at equal intervals in the circumferential direction of the cylinder 22. The scavenging port 56 includes a scavenging chamber 56B defined at a height corresponding to that of the scavenging orifices 55 to surround the cylinder sleeve 19 defining a side portion of the cylinder 22, and multiple (four, in the illustrated example) scavenging passages 56A spaced apart from each other in the circumferential direction of the cylinder 22 and communicating the scavenging chamber 56B and the crank chamber 2A with each other.

As shown in FIG. 1 and FIG. 2, the upper wall surface 56C of the scavenging chamber 56B has an upwardly convex, semicircular shape whose height progressively increases first and then progressively decreases from the radially outer side to the radially inner side, where the radial direction is defined with respect to the cylinder axis A. On the other hand, the lower wall surface 56D of the scavenging chamber 56B is inclined such that the height thereof progressively decreases from the radially outer side to the radially inner side, where the radial direction is defined with respect to the cylinder axis A. The scavenging passages 56A open out in this inclined lower wall surface 56D of the scavenging chamber 56B.

Figure 4:
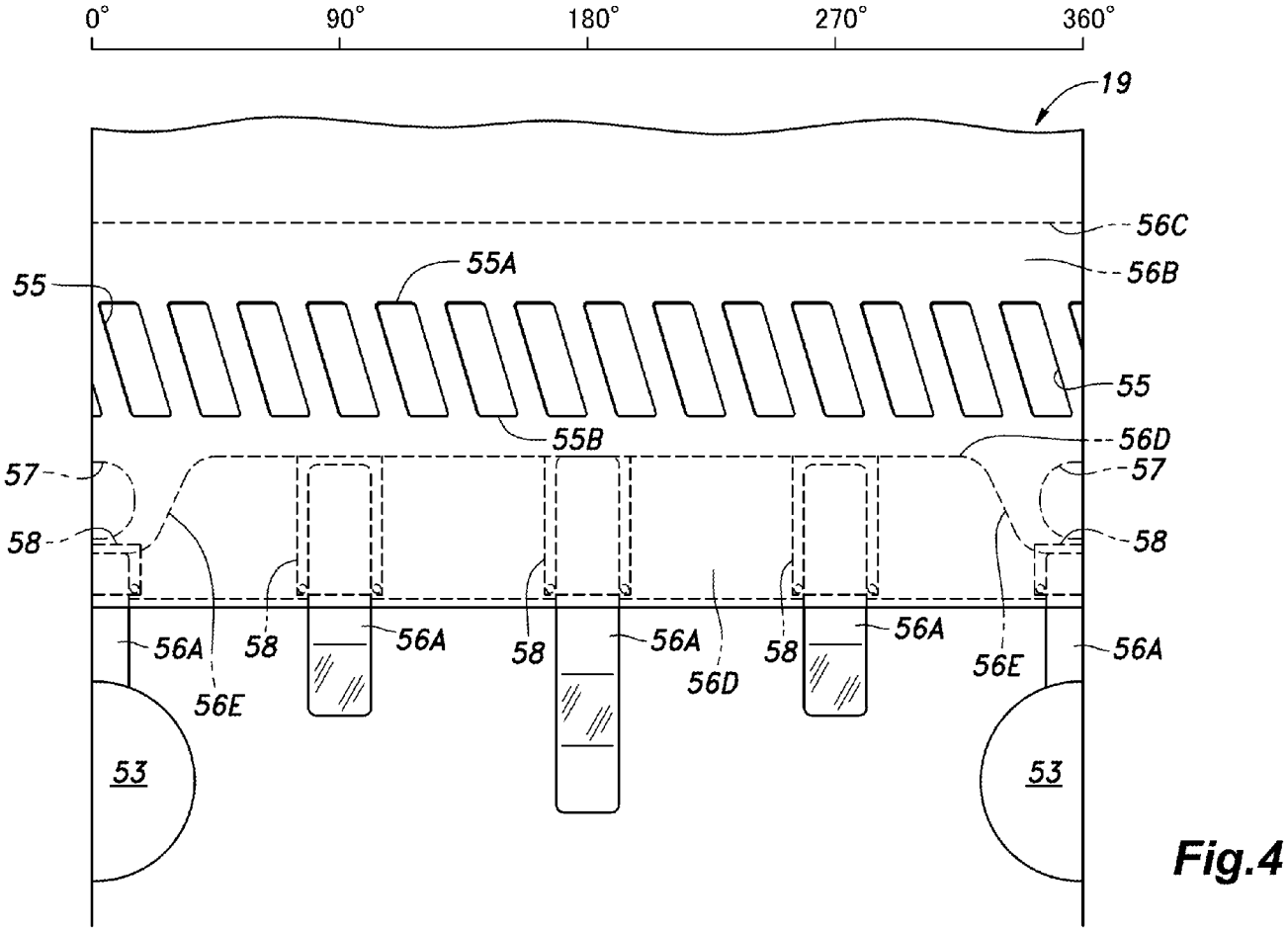
FIG. 4 is a development view of a part including the scavenging port.

FIG. 4 is a development view of a part including the scavenging port 56 developed in the circumferential direction around the cylinder axis A. As shown in FIG. 3 and FIG. 4, each of the scavenging passages 56A forming an upstream portion of the scavenging port 56 has a lower end (upstream end) in communication with the crank chamber 2A and extends upward from the lower end in parallel with the cylinder axis A on a radially outer side of the cylinder sleeve 19 to reach the lower wall surface 56D of the scavenging chamber 56B.

The scavenging chamber 56B mainly forming a downstream portion of the scavenging port 56 extends circumferentially on a radially outer side of the cylinder sleeve 19 and has an annular shape. The scavenging chamber 56B has the upper wall surface 56C located higher than the upper edge 55A of the scavenging orifice 55 and the lower wall surface 56D located lower than the lower edge 55B of the scavenging orifices 55. The lower wall surface 56D of the scavenging chamber 56B is recessed at a part above the opening of the intake port 53 so that this part is positioned lower than the other part, and the scavenging passage 56A opening out in this part has a length shorter than the length of the other scavenging passages 56A (the position of the upper end of the scavenging passage 56A is lower than that of the others). Namely, this recessed part 56E of the scavenging chamber 56B that is recessed downward forms an upstream portion of the scavenging port 56.

In the recessed part 56E of the scavenging chamber 56B, a downstream end of an air supply passage 57 that supplies air to the scavenging port 56 during the air intake opens out at the inner surface of the crankcase 2 serving as a side wall surface of the scavenging chamber 56B. The upstream end of the air supply passage 57 is in communication with a part of the intake port 53 downstream of the reed valve 54, as shown in FIG. 1.

As shown in FIG. 3 and FIG. 4, in the scavenging chamber 56B, reed valves 58 are attached to the lower wall surface 56D of the scavenging chamber 56B to close the openings of all the scavenging passages 56A such that the reed valves 58 permit the flow of fluid from the scavenging passages 56A toward the scavenging chamber 56B while prohibiting the flow of fluid from the scavenging chamber 56B toward the scavenging passages 56A. Each reed valve 58 is secured to the lower wall surface 56D of the scavenging chamber 56B at a radially inner part thereof (a part closer to the cylinder axis A), and, as shown by broken lines in FIG. 1 and FIG. 2, opens the opening of the corresponding scavenging passage 56A when the radially outer part thereof flexes upward. The downstream end of the air supply passage 57 opening out in the recessed part 56E of the scavenging chamber 56B (upstream portion of the scavenging port 56) is connected to a part of the scavenging port 56 downstream of the reed valve 58.

As shown in FIG. 1, an annular oil passage forming member 60 is attached to the outer circumference of the lower end part of the cylinder sleeve 19 projecting into the scavenging chamber 56B. The inner circumference of the oil passage forming member 60 is in surface contact with the outer circumference of the cylinder sleeve 19 in the circumferential direction. The part of the outer circumference of the cylinder sleeve 19 facing the inner circumference of the oil passage forming member 60 is formed with an annular groove that extends annularly in the circumferential direction (reference number is omitted). The annular groove is covered by the oil passage forming member 60 to define an annular channel. The oil passage forming member 60 is provided with an oil inlet hole (reference number is omitted) radially extending therethrough and in communication with the annular groove. The cylinder sleeve 19 is provided with an oil supply hole (reference number is omitted) radially extending therethrough and in communication with the annular groove. Multiple oil supply holes are formed in the circumferential direction of the cylinder sleeve 19.

The cylinder block 3 has a first oil passage 64 formed therein. The first oil passage 64 has one end that opens out at the side surface of the cylinder block 3 and the other end that opens out at the lower end surface of the cylinder block 3. Connected to the open end of the first oil passage 64 that opens out at the lower end surface of the cylinder block 3 is one end of a second oil passage tube 66 that defines a second oil passage. The second oil passage tube 66 extends vertically in the scavenging port 56, and the other end thereof is connected to the oil inlet hole of the oil passage forming member 60. Thereby, the oil press-fed by the oil pump not shown in the drawings passes through the first oil passage 64, the second oil passage tube 66, the oil inlet hole, the annular groove and the oil supply holes in order, and is supplied to the inner wall of the cylinder sleeve 19.

A fuel injection valve 68 is mounted to the rear side wall 2E of the crankcase 2. The tip end of the fuel injection valve 68 is disposed in the crank chamber 2A so as to be directed toward the crankshaft 8, and injects fuel into the crank chamber 2A at a predetermined timing. Thereby, air-fuel mixture is generated in the crank chamber 2A. Namely, only fresh air flows through the intake port 53 (air before generating air-fuel mixture). Thus, the air supply passage 57 whose upstream end is in communication with a downstream side of the reed valve 54 is in communication with a part of the intake port 53 through which air flows, and therefore, air can be supplied from the intake port 53 to the scavenging port 56. Detailed description of the operation will be provided later.

In the following, a description will be made of an outline of the two-cycle operation performed by the engine E having the structure described above. The engine E operates as follows after start-up. With reference to FIG. 1, first, during the upward stroke of the piston 23, the reed valve 54 opens due to a decrease in pressure in the crank chamber 2A caused thereby, and fresh air flows into the crank chamber 2A from the intake port 53. Fuel is injected by the fuel injection valve 68 toward the fresh air that has flowed into the crank chamber 2A, whereby an air-fuel mixture is generated. At the same time, the air-fuel mixture in the combustion chamber 29 is compressed by the piston 23, and, when the piston 23 is near the top dead center, the spark plug 30 performs spark ignition to combust the fuel.

Thereafter, when the piston 23 starts its downward stroke, the reed valve 54 is closed, and the air-fuel mixture in the crank chamber 2A is compressed. As the piston 23 moves downward, the exhaust valve 32 driven by the valve actuating mechanism 34 opens the exhaust port 31 before the piston 23 opens the scavenging port 56. Then, when the piston 23 opens the scavenging orifices 55, the air-fuel mixture compressed in the crank chamber 2A flows into the cylinder 22 (into the combustion chamber 29) through the scavenging port 56. The combustion gas (exhaust gas) in the combustion chamber 29 is discharged through the exhaust port 31 by being pushed out thereby.

When the piston 23 undergoes the upward stroke again, the exhaust valve 32 driven by the cam 47 closes the exhaust port 31 after the piston 23 closes the scavenging port 56, and the air-fuel mixture in the cylinder 22 (combustion chamber 29) is compressed as the piston 23 moves upward. At the same time, the pressure in the crank chamber 2A decreases and the reed valve 54 opens, so that fresh air is taken in through the intake port 53.

In this way, the engine E performs a two-cycle operation. The scavenging flow from the scavenging port 56 to the exhaust port 31 via the cylinder 22 is realized as a uni-flow guided along a relatively straight path.

Figure 5A:
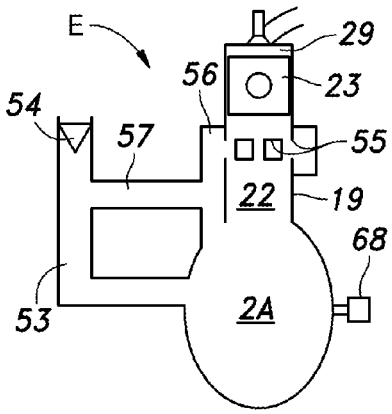
FIGS. 5A-5E are diagrams for schematically showing the structure and mode of operation of the engine according to the embodiment.

Next, a detailed description will be made of the operation and effect of the stratified scavenging performed in the engine E having the air supply passage 57 according to the present embodiment. FIGS. 5A-5E are diagrams for explaining the schematic structure and operation of the engine E according to the embodiment, where FIG. 5A is a schematic structure diagram of the engine E in which the characteristic parts corresponding to the elements in claim 1 are extracted and shown, and FIGS. 5B to 5E are diagrams for explaining the flow of fluid at various time points in the two-cycle operation.

As shown in FIG. 5A, the engine E according to the embodiment includes: the intake port 53 opening out into the crank chamber 2A to fill the crank chamber 2A with air-fuel mixture; the reed valve 54 that is provided in the intake port 53 and permits the flow of fluid toward the crank chamber 2A; the scavenging port 56 having an upstream end communicating with the crank chamber 2A and a downstream end realized by the scavenging orifices 55 opening out in the cylinder sleeve 19 defining a side portion of the cylinder 22, wherein the scavenging orifices 55 communicate with the combustion chamber 29 defined above the piston 23 at least when the piston 23, moving up and down in the cylinder 22, is at the bottom dead center, and communicate with a part of the cylinder 22 below the piston 23 at least when the piston 23 is at the top dead center; and the air supply passage 57 that communicates the part of the intake port 53 which is located downstream of the reed valve 54 and through which air flows with the upstream portion of the scavenging port 56.

Figure 5D:
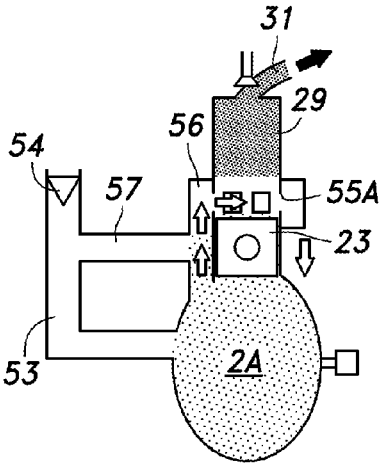
Figure 5B:
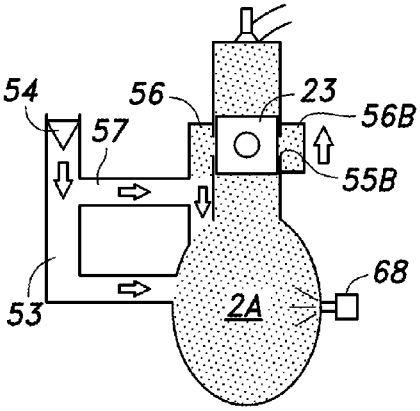

Thus, as shown in FIG. 5B, when the piston 23 is moving upward with the lower edge of the piston 23 being lower than the lower edge 55B of the scavenging orifices 55, a decrease in the pressure in the crank chamber 2A causes the reed valve 54 to open to enable air intake, and the air flows into the crank chamber 2A through the intake port 53 and also through the air supply passage 57 and the scavenging port 56. At this point of time, there is air-fuel mixture in the scavenging chamber 56B serving as a downstream portion of the scavenging port 56.

Figure 5E:
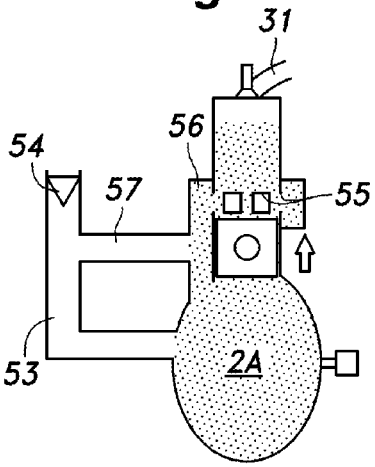
Figure 5C:
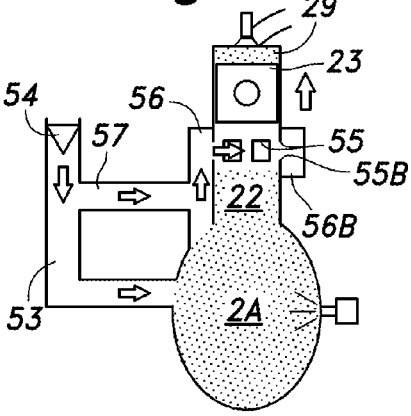

Thereafter, as shown in FIG. 5C, when the piston 23 is moving upward during the air intake with the lower edge of the piston 23 being higher than the lower edge 55B of the scavenging orifices 55, a negative pressure is created at the scavenging orifices 55, whereby the air that has flowed into the scavenging port 56 from the air supply passage 57 flows to the scavenging chamber 56B on the downstream side thereof and then into the cylinder 22 via the scavenging orifices 55.

When the piston 23 is near the top dead center, the spark plug 30 performs spark ignition, whereupon when the piston 23 starts its downward stroke, the reed valve 54 is closed and the compression of the air-fuel mixture in the crank chamber 2A begins. As shown in FIG. 5D, when the piston 23 is moving downward with the upper edge of the piston 23 being lower than the upper edge 55A of the scavenging orifices 55 (the scavenging port 56 being in communication with the combustion chamber 29), first the air in the scavenging port 56 is pushed by the air-fuel mixture in the crank chamber 2A and flows into the combustion chamber 29 through the scavenging orifices 55, and then, the air-fuel mixture in the crank chamber 2A flows into the combustion chamber 29. The combustion gas (exhaust gas) in the combustion chamber 29 is discharged through the exhaust port 31 by being pushed out thereby.

Thereby, stratified scavenging is performed in the combustion chamber 29, whereby when the piston 23 starts the upward stroke again and the exhaust port 31 is closed as shown in FIG. 5E, all the combustion gas has been discharged, and even if the air in the upper layer may be discharged through the exhaust port 31, the air-fuel mixture in the lower layer is prevented from being discharged through the exhaust port 31. Therefore, an increase in the total hydrocarbons (THC) due to the flowing out of the uncombusted air-fuel mixture during the scavenging can be prevented.

Figure 6A:
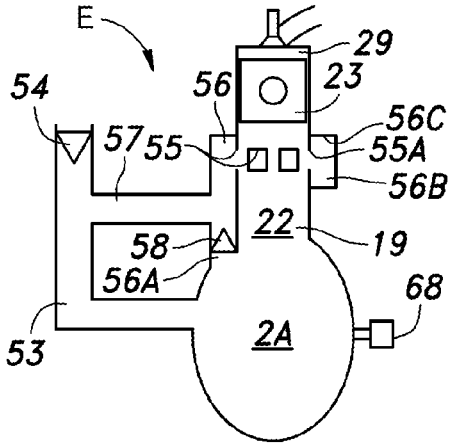
FIGS. 6A-6C are diagrams for schematically showing the structure and mode of operation of the engine according to the embodiment.
Figure 6B:
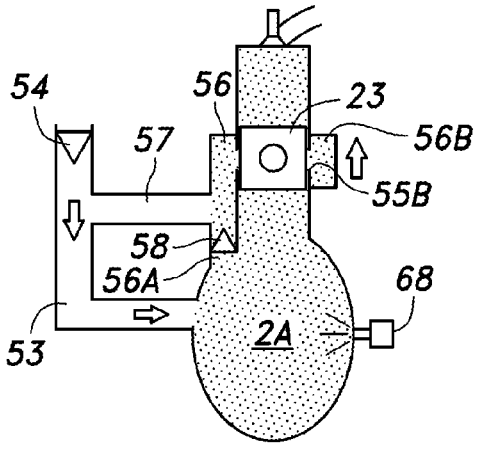
Figure 6C:
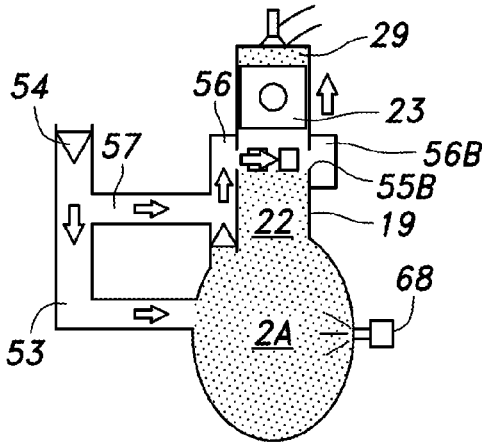

FIGS. 6A-6C are diagrams for explaining the schematic structure and operation of the engine E according to the embodiment, where FIG. 6A is a schematic structure diagram of the engine E in which the characteristic parts corresponding to the elements in claims 2, 3 and 5 are shown in addition to the structure shown in FIG. 5A, and FIGS. 6B and 6C are diagrams for explaining the flow of fluid at various time points in the two-cycle operation. It is to be noted that the operation relating to FIGS. 5D and 5E is the same, and thus, the corresponding diagrams are omitted.

As shown in FIG. 6A, the engine E according to the embodiment further includes, in addition to the structure described above, the reed valve 58 that is provided in the scavenging port 56 and permits the flow of fluid from the scavenging passage 56A on the upstream end side to the scavenging chamber 56B on the downstream end side, where the air supply passage 57 is connected to a part of the scavenging port 56 on the side of the downstream end relative to the reed valve 58.

Thus, as shown in FIG. 6B, when the piston 23 is moving upward during the air intake with the lower edge of the piston 23 being lower than the lower edge 55B of the scavenging orifices 55, the fluid in the scavenging chamber 56B of the scavenging port 56 is prevented from flowing into the crank chamber 2A through the scavenging passage 56A. Namely, the fluid flowing into the crank chamber 2A is only the air that flows therein through the intake port 53. This allows the fluid (air) suctioned during the air intake to flow toward the crankshaft 8 obliquely from above without being disturbed, and thus, the fuel injected into the crank chamber 2A from the fuel injection valve 68 can be easily mixed with the air to generate a homogenous air-fuel mixture.

It is to be noted that, as shown in FIG. 6C, when the piston 23 is moving upward during the air intake with the lower edge of the piston 23 being higher than the lower edge 55B of the scavenging orifices 55, air flows from the air supply passage 57 into the scavenging chamber 56B that serves as a downstream portion of the scavenging port 56. Therefore, when the scavenging orifices 55 are brought into communication with the combustion chamber 29 during the downward stroke of the piston 23, the air held in the scavenging port 56 flows into the combustion chamber 29 first to perform stratified scavenging, as was described with reference to FIGS. 5A-5E.

In the engine E according to the present embodiment, the scavenging port 56 includes the scavenging chamber 56B defined around the cylinder sleeve 19 defining the side portion of the cylinder 22 and the scavenging passage 56A that communicates the scavenging chamber 56B with the crank chamber 2A, and the one-way valve permitting the flow of fluid from the scavenging passage 56A to the scavenging chamber 56B is embodied as the reed valve 58 provided in the scavenging chamber 56B, where the air supply passage 57 is connected to the scavenging chamber 56B.

Thus, the provision of the scavenging chamber 56B increases the volume of the scavenging port 56, making it easy to secure an adequate amount of air to be used in the stratified scavenging. Further, by providing the scavenging chamber 56B having a large volume with the reed valve 58 having a simple structure, the installation of the one-way valve permitting the flow of fluid from the scavenging passage 56A to the scavenging chamber 56B while prohibiting the flow of fluid from the scavenging chamber 56B to the scavenging passage 56A can be achieved easily. Stratified scavenging is performed by the air flowing into the combustion chamber 29, as was described with reference to FIGS. 5A-5E.

Further, as shown in FIG. 6A, the upper wall surface 56C of the scavenging chamber 56B is located higher than the upper edge 55A of the scavenging orifices 55. Thereby, the fluid having passed the scavenging passage 56A impinges upon the upper wall surface 56C of the scavenging chamber 56B such that the upward velocity component thereof is reduced, and thereafter, flows into the combustion chamber 29. Therefore, stratified scavenging is performed in the combustion chamber 29 without the stratified flow being disturbed.

Figure 7A:
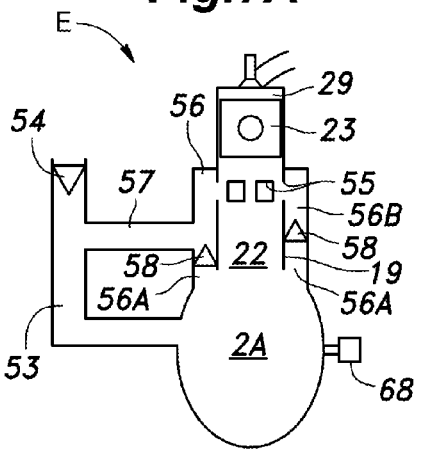
FIGS. 7A-7E are diagrams for schematically showing the structure and mode of operation of the engine according to the embodiment.

FIGS. 7A-7E are diagrams for explaining the schematic structure and operation of the engine E according to the embodiment, where FIG. 7A is a schematic structure diagram of the engine E in which the characteristic parts corresponding to the elements in claim 4 are shown in addition to the structure shown in FIG. 6A, and FIGS. 7B to 7E are diagrams for explaining the flow of fluid at various time points in the two-cycle operation.

As shown in FIG. 7A, in the engine E according to the embodiment, in addition to the structure described above, the scavenging port 56 includes multiple scavenging passages 56A spaced apart from each other in the circumferential direction of the cylinder 22, and the reed valve 58 is provided for all the scavenging passages 56A.

Figure 7D:
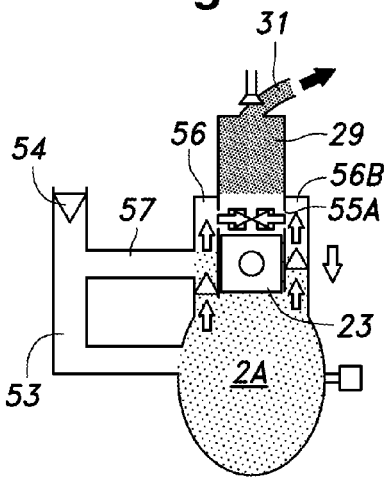
Figure 7B:
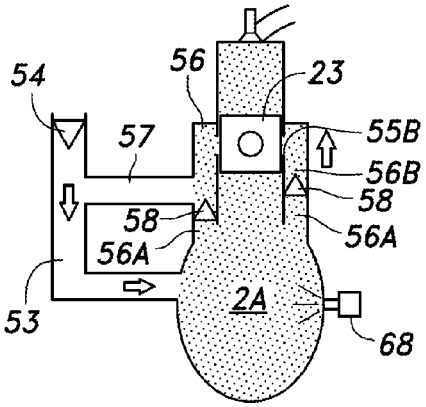

In this structure, the scavenging chamber 56B to which the air supply passage 57 is connected is in flow communication with the scavenging passages 56A. However, as shown in FIG. 7B, when the piston 23 is moving upward during the air intake with the lower edge of the piston 23 being lower than the lower edge 55B of the scavenging orifices 55, the reed valves 58 prevent the air from flowing into the crank chamber 2A by passing through the air supply passage 57, the scavenging chamber 56B and the scavenging passages 56A in order.

Figure 7E:
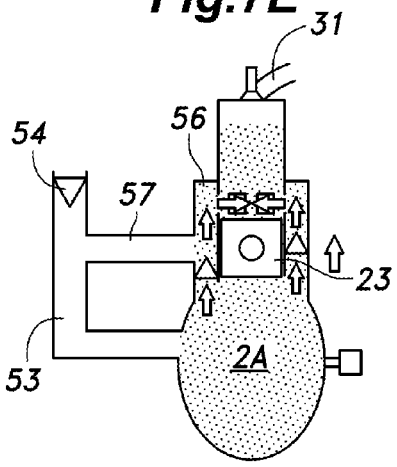
Figure 7C:
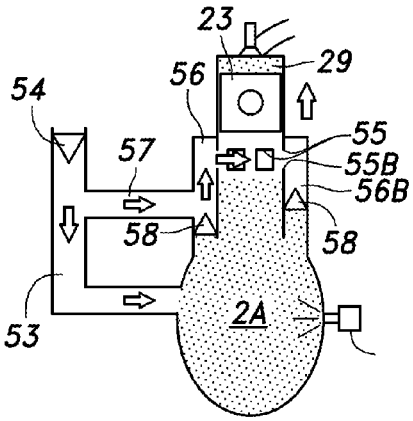

Thereafter, as shown in FIG. 7C, when the piston 23 is moving upward with the lower edge of the piston 23 being higher than the lower edge 55B of the scavenging orifices 55, a negative pressure is crated at the scavenging orifices 55, whereby the air that has flowed into the scavenging chamber 56B from the air supply passage 57 flows through the scavenging orifices 55 into the cylinder 22.

When the piston 23 is near the top dead center, the spark plug 30 performs spark ignition, whereupon when the piston 23 starts its downward stroke, the reed valve 54 of the intake port 53 is closed and the compression of the air-fuel mixture in the crank chamber 2A begins. As shown in FIG. 7D, when the piston 23 is moving downward with the upper edge of the piston 23 being lower than the upper edge 55A of the scavenging orifices 55, first the air in the scavenging chamber 56B is pushed by the air-fuel mixture in the crank chamber 2A via all the scavenging passages 56A and flows into the combustion chamber 29 through the scavenging orifices 55, and then, the air-fuel mixture in the crank chamber 2A flows through all the scavenging passages 56A into the combustion chamber 29. The combustion gas (exhaust gas) in the combustion chamber 29 is discharged through the exhaust port 31 by being pushed out thereby.

In this way, in comparison with the case where a single scavenging passage 56A is provided, the velocity of the fluid flowing into the combustion chamber 29 during scavenging is lowered, and stratified scavenging is performed in the combustion chamber 29 without the stratified flow being disturbed. When the piston 23 starts the upward stroke again and the exhaust port 31 is closed as shown in FIG. 7E, all the combustion gas has been discharged, and even if the air in the upper layer may be discharged through the exhaust port 31, the air-fuel mixture in the lower layer is prevented from being discharged through the exhaust port 31.

Thus, in the engine E according to the embodiment, it is possible to perform stratified scavenging in a two-stroke engine even when a long piston stroke is adopted.

Figure 8A:
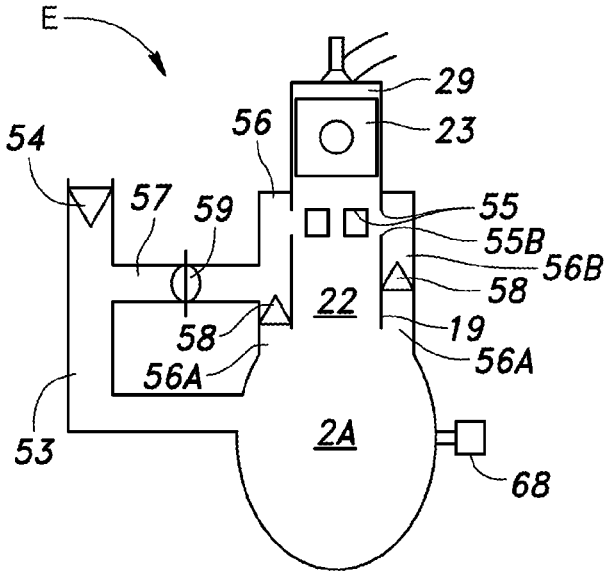
FIGS. 8A and 8B are diagrams for schematically showing the structure and mode of operation of an engine according to a modified embodiment of the present invention.
Figure 8B:
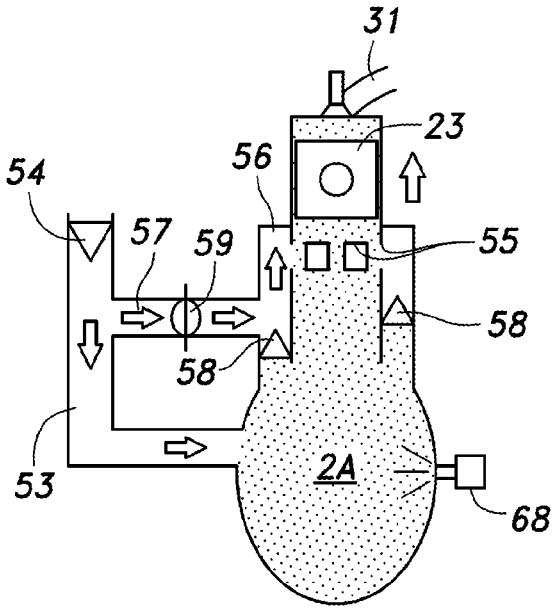
Figure 9A:
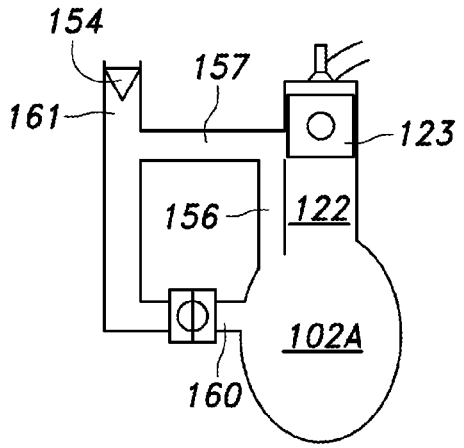
FIGS. 9A-9C are explanatory diagrams for explaining stratified scavenging in a conventional two-stroke engine.
Figure 9B:
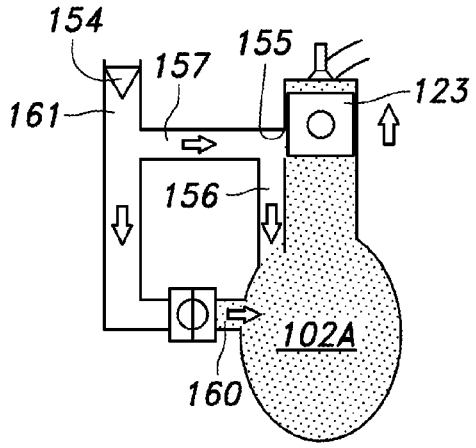
Figure 9C:
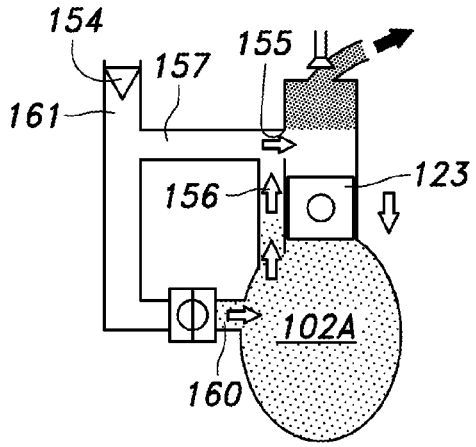
Figure 10A:
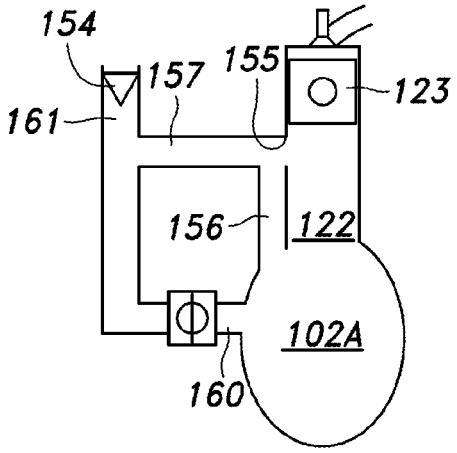
FIGS. 10A-10C are explanatory diagrams for explaining a problem in the conventional structure for stratified scavenging.
Figure 10B:
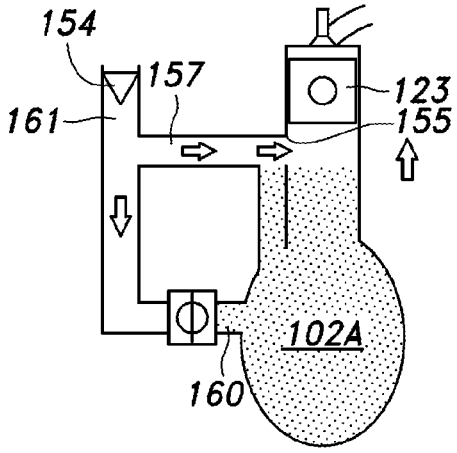
Figure 10C:
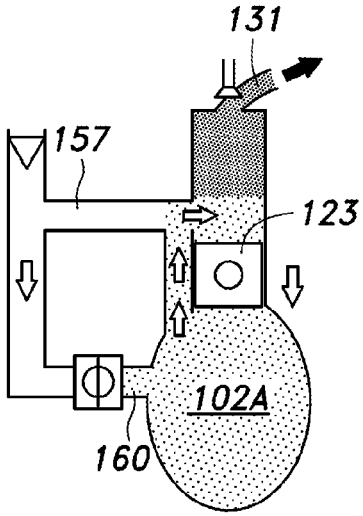

FIGS. 8A and 8B are diagrams for explaining the schematic structure and operation of the engine E according to a modified embodiment, which has a structure that was not included in the engine E shown in FIG. 1 to FIG. 4, where FIG. 8A is a schematic structure diagram of the engine E in which the characteristic parts corresponding to the elements in claim 6 are shown in addition to the structure shown in FIG. 5 to FIG. 7, and FIG. 8B is a diagram for explaining the flow of fluid at a certain time point in the two-cycle operation. It is to be noted that the operation relating to FIGS. 5B, 5D and 5E or FIGS. 7B, 7D and 7E is the same, and thus, the corresponding diagrams are omitted.

As shown in FIG. 8A, the engine E according to the modified embodiment further includes, in addition to the structure described above, a control valve 59 that is provided in the air supply passage 57 and serves as an air amount adjustment device that adjusts an amount of air supplied to the scavenging port 56 during the air intake.

According to this structure, when the piston 23 is moving upward with the lower edge of the piston 23 being lower than the lower edge 55B of the scavenging orifices 55 during the air intake or, as shown in FIG. 8B, when the piston 23 is moving upward with the lower edge of the piston 23 being higher than the lower edge 55B of the scavenging orifices 55 during the air intake, the amount of air supplied to the scavenging port 56 through the air supply passage 57 can be adjusted as desired by the control valve 59. Thus, during the air intake, the fluid passing through the scavenging port 56 is prevented from flowing into the crank chamber 2A via the scavenging orifices 55 or the upstream end of the scavenging passages 56A even if the reed valves 58 that permit the flow of fluid only from the scavenging passages 56A to the scavenging chambers 58B were not provided, whereby it is possible to homogenize the air-fuel mixture in the crank chamber 2A.

A description of the concreate embodiments has been provided in the foregoing, but the present invention is not limited to the above embodiments and various alterations and modifications are possible. For example, in the foregoing embodiment, the present invention was applied to a uniflow two-stroke engine in which the exhaust valve 32 was provided in the cylinder head 4 for instance, but the present invention may be applied to a two-stroke engine in which the exhaust valve 32 is not provided and the exhaust port 31 opens out to the cylinder sleeve 19. Further, the number and shape of the scavenging orifices or the scavenging port 56, for example, may be varied as appropriate. Besides, the concrete structure, arrangement, number, angle, etc. of various components and parts may be varied as appropriate without departing from the spirit of the present invention. On the other hand, not all of the structure elements shown in the foregoing embodiments are necessarily indispensable, and they may be selectively used as appropriate.

The invention claimed is:

1. A two-stroke engine, comprising:

an intake passage that opens out to a crank chamber;

a first one-way valve provided in the intake passage and permits a flow of fluid toward the crank chamber;

a scavenging port having an upstream end communicating with the crank chamber and a downstream end that opens out in a wall defining a side portion of a cylinder, wherein the downstream end communicates with a combustion chamber defined above the piston at least when the piston, moving up and down in the cylinder, is at a bottom dead center, and communicates with a part of the cylinder below the piston at least when the piston is at a top dead center; and an air supply passage that connects the intake passage with an upstream portion of the scavenging port such that air is supplied from the intake passage to the scavenging port during air intake, wherein the intake passage includes a part which is located downstream of the first one-way valve and through which air flows, and wherein the air supply passage connects the part of the intake passage with the upstream portion of the scavenging port, wherein the two stroke engine further comprises a second one-way valve that is provided in the scavenging port and permits the flow of fluid from the upstream end toward the downstream end, wherein the air supply passage is connected to a part of the scavenging port on a downstream side of the second one-way valve, and wherein: the scavenging port includes an annular scavenging chamber defined around the wall defining the side portion of the cylinder and a scavenging passage that communicates the scavenging chamber and the crank chamber with each other;

the second one-way valve consists of a reed valve provided in a connecting part of the scavenging chamber with the scavenging passage; and the air supply passage is connected to the scavenging chamber.

2. The two stroke engine according to claim 1, wherein:

the scavenging port includes a plurality of scavenging passages spaced apart from each other in a circumferential direction of the cylinder; and the second one-way valve is provided for all the scavenging passages.

3. The two-stroke engine according to claim 1, wherein the scavenging chamber has an upper wall surface located higher than an upper edge of the downstream end of the scavenging port.

4. The two-stroke engine according to claim 1, further comprising an air amount adjustment device that is provided in the air supply passage and adjusts an amount of air supplied to the scavenging port during air intake.

5. The two-stroke engine according to claim 2, wherein the scavenging chamber has an upper wall surface located higher than an upper edge of the downstream end of the scavenging port.

6. The two stroke engine according to claim 1, wherein the scavenging port includes a plurality of scavenging orifices each extending through the wall defining the side portion of the cylinder and constituting the downstream end, the plurality of scavenging orifices being arranged at equal intervals in a circumferential direction of the cylinder.

7. The two stroke engine according to claim 1, wherein the scavenging chamber has a lower wall surface located lower than a lower edge of the downstream end of the scavenging port.

* * * * *